United States Patent [19]

Kals

[11] Patent Number: 4,531,576

[45] Date of Patent: Jul. 30, 1985

[54] APPARATUS FOR COOLING FLUIDS

[75] Inventor: Walter Kals, Hastings-On-Hudson, N.Y.

[73] Assignee: Niagara Blower Co., Buffalo, N.Y.

[21] Appl. No.: 562,207

[22] Filed: Dec. 16, 1983

[51] Int. Cl.[3] ..... F28F 13/06

[52] U.S. Cl. ..... 165/108; 165/96; 165/124; 165/DIG. 1

[58] Field of Search ..... 165/96, 108, 124, DIG. 1; 98/119

[56] References Cited

U.S. PATENT DOCUMENTS

| | | | |
|---|---|---|---|
| 2,454,883 | 11/1948 | Olstad et al. . | |
| 3,139,020 | 6/1964 | Schemenauer | 165/96 X |
| 4,273,733 | 6/1981 | Kals | 261/151 |
| 4,450,899 | 5/1984 | Jakobsson et al. | 165/DIG. 1 X |

*Primary Examiner*—William R. Cline
*Assistant Examiner*—Peggy A. Neils
*Attorney, Agent, or Firm*—Niro, Scavone, Haller & Niro

[57] ABSTRACT

A heat exchange device is disclosed in the form of a condenser for vapors containing non-condensible gases. Mechanical shutter members in the form of air foils are pivotally mounted in the exhaust stacks of the condenser for selectively blocking the exhaust stack to prevent back draft through the condenser when the respective air circulation fan thereof is inoperative. In one form of the invention, the condenser includes air recirculation ducts which also can be selectively closed by dampers to prevent back draft through the return ducts when the respective air recirculation fan is inoperative.

3 Claims, 5 Drawing Figures

APPARATUS FOR COOLING FLUIDS

BACKGROUND OF THE INVENTION

This invention relates to a heat exchange device and, more particularly, to an air cooled vacuum producing condenser. Specifically, the invention relates to an air cooled heat exchanger wherein an air moving means induces air flow over heat exchange means and outwardly to atmosphere through a plenum or exhaust stack.

An air cooled heat exchanger generally consists of a tubular heat transfer surface and a fan. Fluid passing through the tubes surrenders heat to air propelled by the fan over the external tube surface. The heat energy of air passing over the tubes increases in the same amount as the heat energy lost by the fluid, assuming that no other heat losses occur. A reduction of the air mass passing over the heat transfer surface will reduce the amount of absorbed heat by a proportionate amount. Therefore, the cooling capacity can be controlled by varying the air mass passing over the tubular heat transfer surface.

This invention is particularly adapted for relatively large capacities as may be required for condensing the exhaust of steam turbines. In large capacity installations, a plurality of fans may be utilized, the fans having a plenum in common on their suction side of each having its own individual exhaust stack for discharging the air from the interior chamber of the condenser. One method of reducing the air mass passing over the heat transfer surface of such large capacity units is to simply shut down one or more of the fans. This measure will conserve fan energy in colder weather when operation with fewer fans will provide the necessary cooling capacity. An individual fan also may be rendered inoperative due to malfunctions. The fan may have to be removed for repair or replacement. If a fan is shut down for one reason or another, a back draft problem is created. In other words, the remaining operative fans will induce a downward flow of air through the ring or cylinder of the inoperative fan and thereby reduce the flow of air over the heat transfer surface.

Heretofore, continued operation of such a unit with one of the fans inoperative required covering the respective fan with a blocking means, such as a common board, to block any downward air flow through the fan induced by the remaining operative fans. This has been a rather crude expedient. Covering the fan ring or cylinder of an inoperative fan would be too laborious or even impractical if individual exhaust stacks are used. Covering the top of the stack and preventing the cover from falling off can also be considered a cumbersome undertaking. Back draft dampers placed permanently in the vertical air exhaust channel to open by the velocity pressure of the moving air would debilitate the fan performance.

This problem is further compounded in condenser units where some or all of the exhaust air in the plenum is recirculated through a port in the exhaust stack and back over the heat transfer surface for adjusting the cooling capacity of the unit. If a particular fan is rendered inoperative and the fan ring or cylinder is too inaccessible for being covered, the other alternative of covering the top of the stack would allow the remaining operative fans to cause a back draft of air through the recirculating port of the stack and thence through the ring of the inoperative fan into the plenum, thereby reducing the flow of air over the heat transfer surface.

There is a definite need for a new and improved heat exchange device which has means for selectively blocking the exhaust stack to prevent back draft through the condenser when a particular fan is inoperative. This invention is directed to solving such problems.

SUMMARY OF THE INVENTION

An object, thereof, of the invention is to provide a new and improved heat exchange device which includes means for selectively blocking back draft through an inoperative air moving means.

Another object of the invention is to provide means for preventing such back draft in a unit which includes air recirculation means.

A further object of the invention is to utilize such means for blocking back draft to enhance the fan performance if no blocking of back draft is required.

In the exemplary embodiment of the invention, a heat exchange device for cooling a fluid is disclosed in the form of a condenser for vapors containing non-condensible gases and includes means defining a condenser chamber and means for discharging air from the condenser chamber. A housing has air duct means therethrough, with heat exchange means in the air duct means. Air circulation means is provided in the air duct means downstream of the heat exchange means for drawing a stream of air through the air duct means past the heat exchange means. Plenum means in the form of an exhaust stack is provided downstream of the air circulation means through which air is exhausted to atmosphere. Return duct means is provided in the exhaust stack for selectively returning at least some air back to the duct means at a point upstream of the heat exchange means. Air recirculation means is operatively associated with the exhaust stack and the return duct means for selectively recirculating all, some or none of the air stream in the exhaust stack back through the return duct means. Damper means is provided for selectively opening and closing the return duct means, whereby the air recirculation means can close the exhaust stack and the damper means can close the return duct means to prevent back draft through the device when the air circulation means is inoperative.

In particular, the exhaust stack or plenum is provided with an exhaust port and a return port. The air recirculation means is movable between positions closing either of said ports. The damper means is disposed in the return port, whereby the air recirculation means can close the exhaust port and the damper means can close the return port to prevent back draft through the air circulation means when inoperative.

In a form of the invention, the exhaust stack has upstanding wall means and an air foil movable from a position overlying the wall means to a position blocking the exhaust stack to prevent back draft therethrough. The air foil cooperates with an opposite side wall of the exhaust stack to define diverging interior surface means to recover a portion of the kinetic energy of the air expelled by the air circulation means for converting the air velocity head into a pressure head as the interior of the exhaust stack diverges. In another form of the invention, a pair of shutter members in the form of air foils are pivotally movable about their trailing edges for movement between positions overlying opposite side walls of the exhaust stack where they define diverging interior surface means, to positions jointly blocking the exhaust stack for preventing back draft therethrough.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and advantages thereof, may be best understood by reference to the following description taken in conjunction with the accompanying drawings, in which like reference numerals identify like elements in the figures and in which:

DETAILED DESCRIPTION OF THE INVENTION

Figure 1:
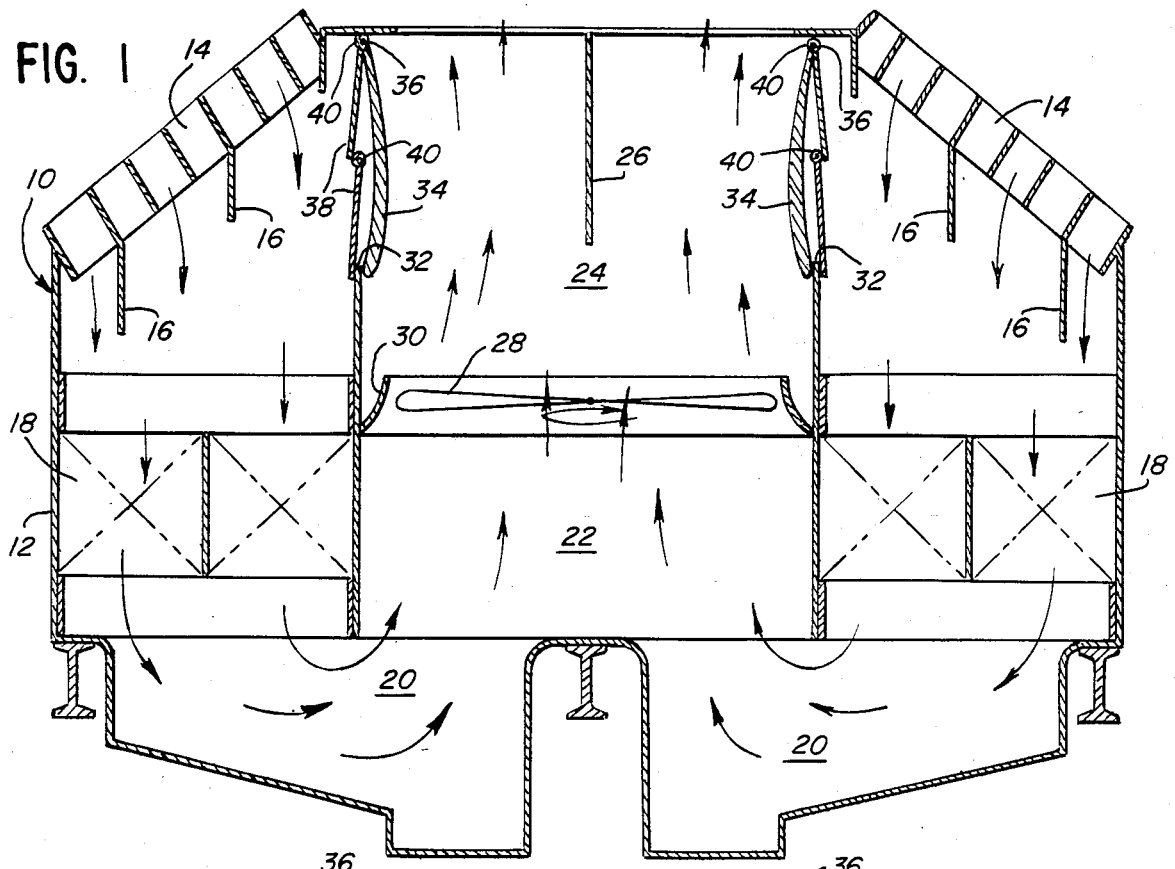
FIG. 1 is a simplified, somewhat schematic section through a vacuum producing condenser embodying features of the invention, with the air recirculation means leaving the exhaust port completely open, the damper means being fully closed.

Referring to the drawings in greater detail, and first to FIG. 1, a heat exchange device is disclosed in the form of a condenser, generally designated 10, for vapors containing non-condensible gases. Housing means, generally designated 12, defines air duct means through the condenser. The inlet to the air duct means is through a pair of fixed grates 14 whereby fresh incoming air is directed downwardly by baffles 16. The air duct means is generally W-shaped configuration passing downwardly through a pair of cooling means 18 beneath grates 14. The air duct means extends downwardly from cooling means 18, into a pair of collection basins 20 and back upwardly through a common plenum 22. The plenum terminates upwardly in an exhaust stack 24 which is disposed between grates 14 and which has a central partition 26.

Air cooling means 18 can consist of various types of heat exchange means but commonly comprises bundles of tubes through which fluid passes and which defines tubular heat transfer surface means.

Air circulation means is provided in the form of a fan 28 surrounded by a ring 30 and disposed in plenum 22 for drawing a stream of air through the air duct means past heat exchange means 18 and forcing air upwardly through exhaust stack 24. Return duct means in the form of return ports 32 are provided in the side walls of exhaust stack 24 for returning at least some air back to the air duct means at a point upstream of heat exchange means 18. Air recirculation means in the form of a pair of air foils 34 are pivotally movable about their trailing edges 36 and are operatively associated with exhaust stack 24 and return ports 32 for selectively recirculating all, some or none of the air stream in the exhaust stack back through return ports 32, as described in greater detail hereinafter. Dampers 38 are pivotally movable about their trailing edges 40 for selectively opening and closing return port 32.

Figure 2:
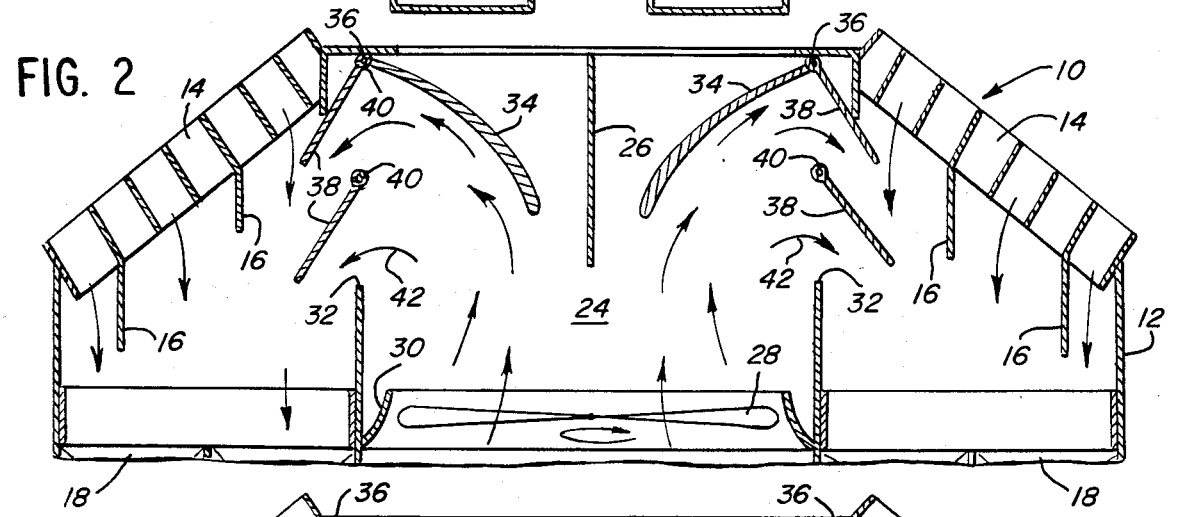
FIG. 2 is a fragmented view similar to that of FIG. 1, with the air recirculation means partly closing the exhaust port and the damper means being opened by the velocity pressure of recirculating air.
Figure 3:
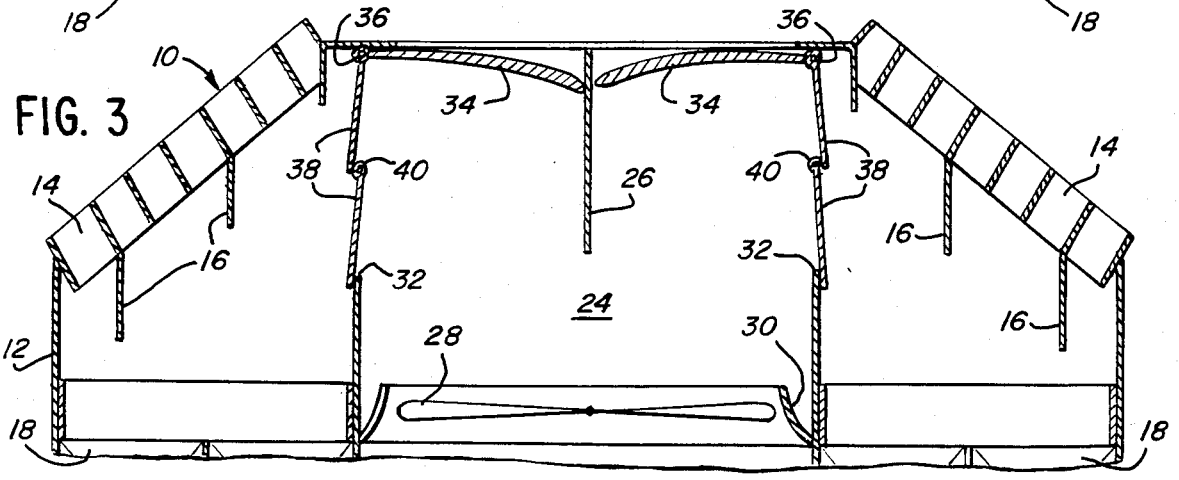
FIG. 3 is a fragmented view similar to that of FIG. 1, with the air recirculation means completely closing the exhaust port and the damper means being fully closed as the respective fan is inoperative and exerts no velocity pressure for recirculating the discharged air.

FIG. 1 illustrates the air recirculation means in the form of air foils 34 completely closing return ports 32, with dampers 38 also completely closed, whereby all of the air discharged by fan 28 is forced upwardly through exhaust stack 24 to atmosphere. FIG. 2 illustrates air foils 34 in intermediate positions, and with dampers 38 fully open to recirculate some of the air stream in exhaust stack 24 through return ports 32, as at 42, back through cooling means 18 to thereby permit adjusting the cooling capacity to the cooling load. FIG. 3 illustrates air foils 34 completely closing the exhaust port and abutting central partition 26 completely close exhaust stack 24. Dampers 38 are in completely closed positions, illustrating the condition of air foils 34 and dampers 38 when fan 28 is rendered inoperative to prevent any back draft either through exhaust stack 24 or return ports 32.

From the foregoing it can be seen that a recirculating heat exchange device has been provided whereby either the exhaust stack or the return duct or port(s) can be selectively opened, partially opened or closed at will. Of course, any known mechanical apparatus can be employed to mechanically position the air foils for the required proportions of exhaust and recirculation volumes. For example, one such mechanism is shown in my U.S. Pat. No. 4,273,733 which is assigned to the assignee of the present invention and which is incorporated by reference herein. The dampers 38 in the return ports 32 are opened by the velocity pressure of recirculating air and will close when no such pressure prevails because the respective fan is inoperative. It should be understood that the combination of elements illustrated in FIGS. 1–3 would be duplicated in a large capacity unit employing a plurality of fans 28 and respective plenums/exhaust stacks. Thus, if one or more fans are rendered inoperative for one reason or another, the respective exhaust stack can be completely closed off to prevent back draft therethrough while the remaining fans continue to operate and draw air past the cooling means.

Figure 4:
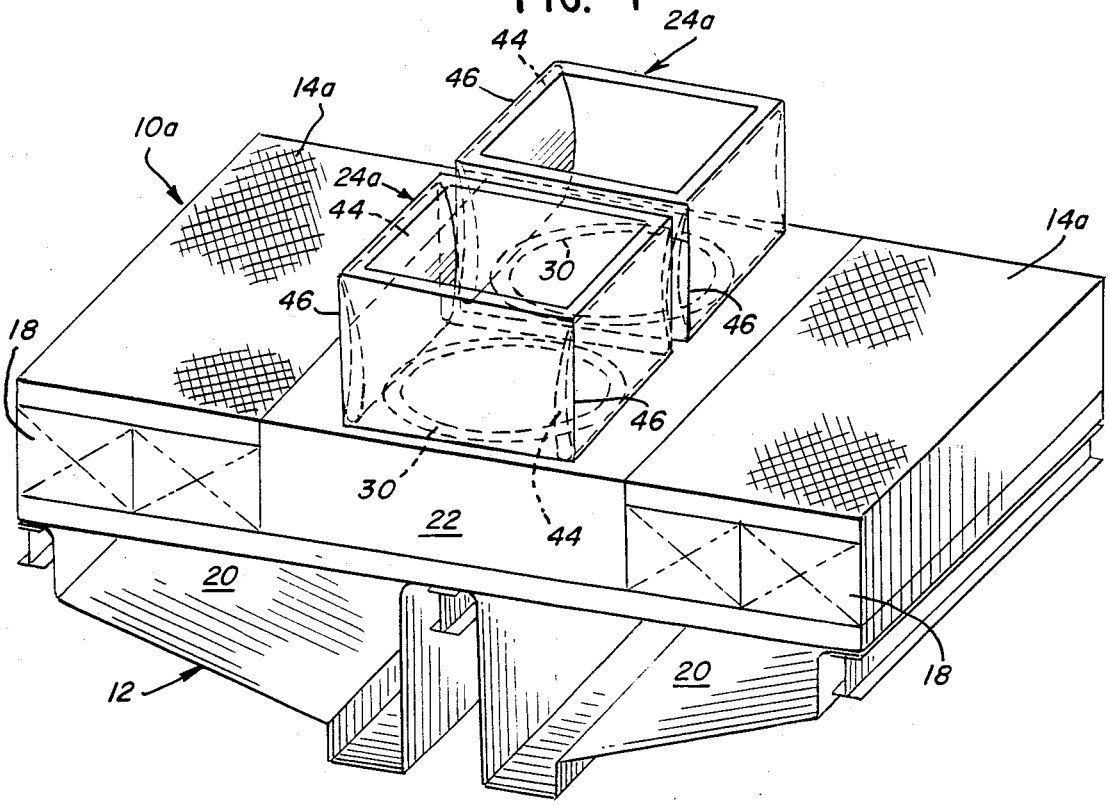
FIG. 4 is a simplified, somewhat schematic perspective view of a vacuum producing condenser embodying a pair of exhaust stacks each having a pair of pivotally mounted air foils for closing the stacks.

Turning to FIG. 4, another condenser, generally designated **10*a*, is illustrated and like components have been designated with like numerals corresponding to those described in relation to FIG. 1. Condenser 10*a* is a non-recirculating installation and includes generally horizontal air intake grates 14*a*. The generally W-shaped air duct means described in relation to FIG. 1 is similar to the condenser of FIG. 1. This condenser includes a pair of exhaust stacks, generally designated 24*a*, defined by upstanding wall means. Each exhaust stack has its respective fan surrounded by a fan ring 30**.

Each exhaust stack **24*a* (FIG. 4) is provided with a pair of shutter members 44 in the form of air foils similar to air foils 34 illustrated in FIGS. 1–3. However, with condenser 10*a*, the air foils in each exhaust stack 24*a* are movable from positions overlying opposite side walls 46 of the respective exhaust stack to positions blocking the exhaust stack as shown in FIG. 3 to prevent back draft through the condenser when a respective propeller 28** is inoperative. The air foils cooperate with the upstanding wall means of the respective exhaust stack to completely close off the exhaust stack and thereby prevent back draft therethrough. In their fully opened positions, the air foils, overlying opposite side walls of the respective exhaust stack, define diverging interior surface means to recover a portion of the kinetic energy of the air expelled by the respective fan for converting the air velocity head into a pressure head as the interior of the respective exhaust stack diverges.

Figure 5:
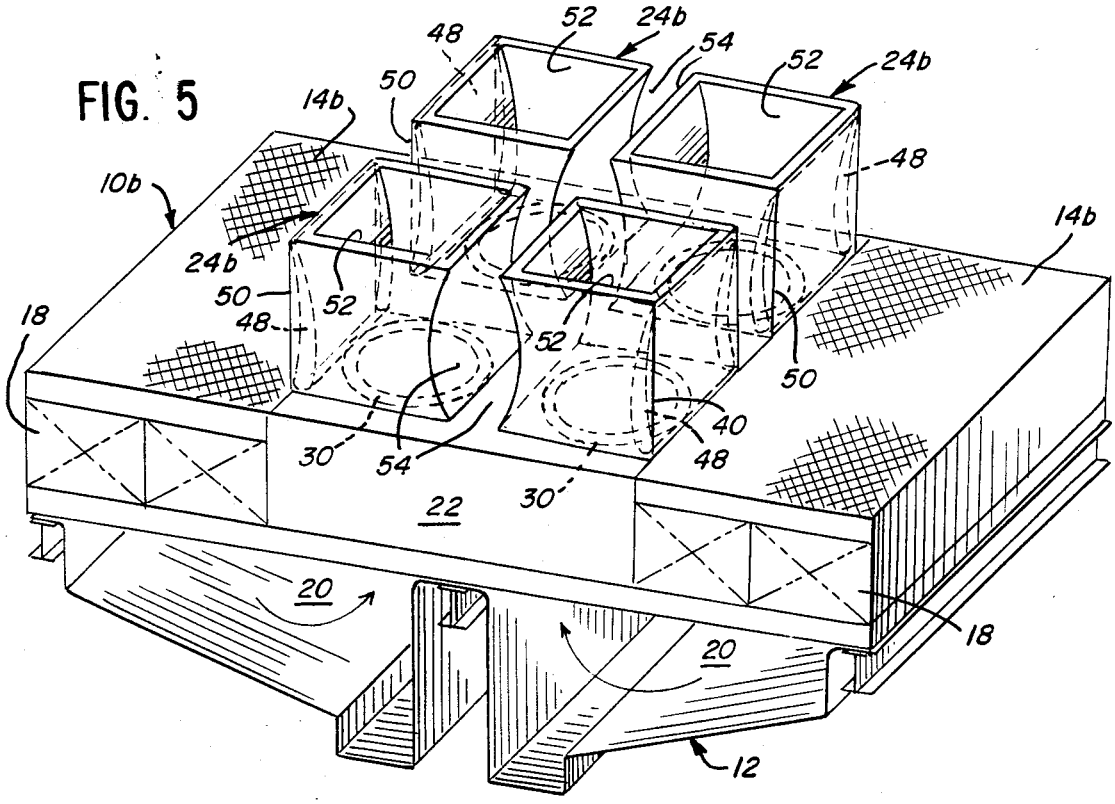
FIG. 5 is a view similar to that of FIG. 4, of a condenser embodying four exhaust stacks each having a single air foil for closing the respective stack.

FIG. 5 illustrates another condenser, generally designated 10*b*, wherein like components have been designated with like numerals corresponding to similar components described in relation to FIG. 1. As with condenser 10*a* illustrated in FIG. 4, condenser 10*b* with FIG. 5 is a non-recirculating unit and includes generally horizontal air intake grates 14*b*. The symmetry of this condenser is kept intact by having two pairs of fans with exhaust stacks, generally designated 24*b*, disposed at either side of the center, each pair to serve the heat exchange means 18 located at the corresponding side. Of course, it should be understood that in any of the embodiments illustrated in any of FIGS. 1—5, the number of exhaust stacks and related components are not limited to the particular number illustrated.

Each exhaust stack 24*a* of condenser 10*b* (FIG. 5) is provided with a single air foil 48 pivotally mounted about its trailing edge 49 adjacent the top of an adjacent vertical wall 50 of the respective exhaust stack. Each air foil is independently movable from a position as illustrated in FIG. 5 overlying the respective vertical wall 50 and fully opening the respective exhaust stack, to generally horizontal positions completely closing an exhaust port 52 of the respective exhaust stack. In closed condition, any back draft through the respective exhaust stack is precluded should the respective fan be inoperative for any reason.

In the embodiment of FIG. 5, each exhaust stack 24*b* has a vertical wall 54 disposed opposite the respective air foil 48 defining a diverging interior surface cooperating with the respective air foil for converting the air velocity head into a pressure head as the interior of the exhaust stack diverges.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

What is claimed is:

1. A heat exchange device for cooling a fluid, comprising:

housing means having air duct means therethrough;

heat exchange means in said air duct means;

air circulation means in said air duct means downstream of said heat exchange means for drawing a stream of air through said air duct means past said heat exchange means;

plenum means downstream of said air circulation means and including an exhaust port through which the air is exhausted to atmosphere;

a return port in said plenum means for returning at least some air back to said duct means at a point upstream of said heat exchange means;

air recirculation means operatively associated with said plenum means, said exhaust port and said return port and movable between positions closing either of said ports for selectively recirculating all, some or none of the air stream in said plenum means back through said return port; and damper means disposed in said return port for selectively opening and closing said return port in response to the position of said air recirculating means and the operative condition of said air circulating whereby said air recirculation means can close said plenum means and said damper means can close said return port to prevent back draft through the device when said air circulation means is inoperative.

2. The heat exchange device of claim 1 wherein said air recirculation means is in the form of an air foil.

3. In a condenser for vapors containing non-condensible gases, means defining a condenser chamber, and means for discharging air from said condenser chamber, said discharging means comprising:

means for forcing air upwardly through an exhaust stack including an exhaust port;

a return port in said exhaust stack for returning at least some air from the exhaust stack back to said condenser chamber;

air recirculation means operatively associated with said exhaust stack, said exhaust port and said return port and movable between positions closing either of said ports for selectively recirculating all, some or none of the air stream in said exhaust stack back through said return port; and damper means disposed in said return port for selectively opening and closing said return port in response to the position of said air recirculating means and the operative condition of said air forcing means, whereby said air recirculation means can close said exhaust stack and said damper means can close said return port to prevent back draft through the condenser when said air forcing means is inoperative.

* * * * *